US005716114A

United States Patent [19]

Holmes et al.

[11] Patent Number: 5,716,114

[45] Date of Patent: Feb. 10, 1998

[54] JERK-RESISTANT DRAWER OPERATING SYSTEM

[75] Inventors: William K. Holmes, San Diego; David R. Williams, Temecula, both of Calif.

[73] Assignee: Pyxis Corporation, San Diego, Calif.

[21] Appl. No.: 659,945

[22] Filed: Jun. 7, 1996

(Under 37 CFR 1.47)

[51] Int. Cl.[6] ..... E05B 65/46

[52] U.S. Cl. ..... 312/215; 312/333

[58] Field of Search ..... 312/215, 222, 312/333, 237, 334.44, 223.1

[56] References Cited

U.S. PATENT DOCUMENTS

| | | | |
|---|---|---|---|
| 5,014,875 | 5/1991 | McLaughlin et al. . | |
| 5,087,107 | 2/1992 | Fumanelli | 312/333 |
| 5,263,596 | 11/1993 | Williams . | |
| 5,346,297 | 9/1994 | Colson, Jr. et al. . | |
| 5,392,951 | 2/1995 | Gardner et al. . | |
| 5,520,450 | 5/1996 | Colson, Jr. et al. | 312/215 |
| 5,564,803 | 10/1996 | McDonald et al. | 312/215 |

*Primary Examiner*—Peter M. Cuomo

*Assistant Examiner*—Gerald A. Anderson

*Attorney, Agent, or Firm*—Standley & Gilcrest

[57] ABSTRACT

A drawer operating system for controlling a drawer having a sliding direction, the drawer defined by a front end and a rear end and partitioned by walls into a plurality of bins consecutive with one another along the sliding direction for holding various dispensable items, the drawer housed in a cabinet and arranged to move between a closed position and graduated, progressively open positions to allow access to one or more bins and the contents stored therein, the system including a linear encoder for monitoring the position and direction of movement of the drawer, including the length of opening the drawer on its preceding excursion, and for producing a plurality of electronic signals specific to the position and movement of the drawer, a drawer stop device arranged between the drawer and the cabinet, a controller for receipt of the electronic signals, and an electric solenoid, including a spring-loaded plunger slidingly mounted therein, for activation by the controller, after the beginning of the drawer-opening sequence, and during translational movement along the drawer stop device to drive a trigger attached thereto into contact with the drawer stop device to prevent the drawer from being manually opened beyond a certain distance out from the cabinet wherein a bin containing the items to be withdrawn is exposed.

38 Claims, 8 Drawing Sheets

JERK-RESISTANT DRAWER OPERATING SYSTEM

RELATION TO OTHER PATENT APPLICATIONS

This patent application is an outgrowth of our previously-filed Provisional Patent Application, filed Aug. 1, 1995 to which Ser. No. 60/001,737 has been assigned, and not abandoned prior to the filing date of this patent application.

BACKGROUND OF THE INVENTION

1. Field of the Invention

This invention pertains to a system for operating one or more drawers that are housed in cabinets, either alone or in multiples of many drawers in a single cabinet, such as in medication or supply cabinets or stations for dispensing pharmaceutical or other supply items from locked storage. More particularly, the invention pertains to a system for controlling the drawers such that they may be opened only a certain distance to expose only certain items with the rest of the items remaining securely stored in the cabinet and, more importantly, that the drawers cannot be jerked open in an effort to expose unauthorized supplies.

2. Description of the Prior Art

The practice of storing and dispensing pharmaceutical items and hospital supplies from locked storage has, over the past several years, become a rather common practice. The benefits of such a practice are readily apparent and are increasingly needed to reduce medical costs and improve efficiency. With controlled storage and dispensing, the existing stock of items is completely used up before new stock is added, resulting in reduced loss from exceeding the expiration dates on certain items. Theft is controlled and/or virtually eliminated, especially theft of controlled substances such as narcotics, steroids, and the like. The patient*s records are more accurately controlled and more efficiently handled by computers interconnected the storage and dispensing cabinets. And, reordering of exhausted or near-exhausted supplies is faster and more carefully controlled. There appears to be no limit to the benefits of these practices. Our previous inventions, disclosed and claimed in U.S. Pat. No. 5,014,875 and U.S. Pat. No. 5,346,297, have been greatly assimilated into the aforesaid practice and represent the state-of-the-art.

Presently, the storage and dispensing of small items, such as ampules, syringes and other small, cylindrically-shaped items are handled by high-density storage and dispensing devices, as disclosed and claimed in U.S. Pat. No. 5,263,596. Larger items are stored in and dispensed from large, supply cabinet-sized auxiliary units, as disclosed and claimed in U.S. Pat. No. 5,346,297. For smaller items that are not slender in size or that are loosely housed in small packets, such as packages of aspirin, packets of laxatives, bandages, and the like, neither the high-density devices nor the auxiliary units are extremely efficient. These items would be more efficiently stored and dispensed from drawers of various sizes.

Unfortunately, most drawers housed in cabinets operate only between fully-open and closed positions, thus allowing access to all the contents in the entire drawer. This is not acceptable where controlled dispensing is required. There are some patents that control the motion of a drawer from a closed to an open position, such as in U.S. Pat. No. 5,392,951. However, total control over the drawer is not thought to be necessary in some medical circles. What is needed is a drawer-operating system that allows graduated access to a drawer so that items stored in the drawer may be extracted from the front of the drawer and access given to deeper and more rearward parts of the drawer only after inventories in the front have been exhausted. If the distance the drawer slides open can be controlled, then the cabinet can function as a security device, retaining therein those items that are not authorized to be dispensed when the drawer is partially opened. Unfortunately, there are those who would abuse any such system in an effort to obtain access to items to which they are not authorized. With drawer storage, there is the ever-present threat that a user will jerk the drawer open in an effort to by-pass any security device lock and achieve full opening of the drawer whether authorized or not.

The benefits of a workable security arrangement of this type are many. First, only one drawer is opened so that the user does not have to search through all of the drawers to locate the needed item. Secondly, all other items in all other drawers are retained in locked storage and not accessible until appropriate clearance is obtained. Third, with the drawer openable only a limited distance out of the cabinet, items at the rear are retained in locked storage. Fourth, with only partial opening and graduated access, the user is forced to use items stored in the front of the drawer, thus insuring the utilization of existing inventory before access to fresher inventory is granted. Finally, should theft occur, identification of the culprit is easily determined, because only the previous user had access to the other inventory in the drawer. Thus, the blame falls on his or her shoulders.

An important feature would be to allow the user to manually pull the drawer open to its fully authorized extent, instead of having it driven fully open. This is because a driven drawer might strike the user who is unaware it is opening. In addition, the user may wish to place a tray or other device under the drawer for aid in unloading the bin. If the drawer is driven open, it may interrupt this activity or knock the tray from the user's hands.

Another important feature that does not exist in the prior art is the ability to pre-load the bins in the drawer at a location remote from the dispensing cabinet. Presently, one must go to the dispensing cabinet, shut it down, open all the drawers and fill the bins with new supplies. This causes downtime of the cabinet and interrupts the normal work schedule of the personnel that use the cabinet. If a way could be found to fill the drawers at a remote location, say at the pharmacy, and seal the bins with a cover, then the newly filled drawers could be brought to the cabinet and inserted therein to eliminate the downtime.

SUMMARY OF THE INVENTION

This invention is a unique drawer operating system comprising an interconnected "engine" and a "dispensing drawer" for allowing graduated access to consecutively spaced bins, partitioned in the drawer, so that access to the bins is controlled. The engine is housed at the rear of each system and remains out of sight and out of the reach of potential thieves. It tracks the previous activity of the drawer and, when later accessed, allows the drawer to be pulled opened to a length that will expose the contents of a bin either not emptied or not uncovered in previous openings, thus retaining the other item-filled bins inside the cabinet and secure from access.

In the preferred embodiment, the drawer is driven from its fully-closed position to a slightly-opened position of one inch or so, to indicate to the user that this particular drawer is further openable by merely pulling it outward. When the drawer is later pushed toward its closed position, it encounters a bias pressure that reduces the effect of "slamming" the drawer into a locked position in the cabinet. This latter feature reduces the potential for the shock of slamming a drawer from causing damage to the rest of the contents therein. Even further, this invention tracks the rate of change of acceleration of the drawer as it is manually pulled open. When a rate of change is measured, that is indicative of the drawer beginning to be jerked open, the drawer is immediately locked against further opening and the user advised to open the drawer more slowly. This invention also solves the problem of loading the supplies at a location remote from the cabinet. This invention separates the engine from the bin-filled drawer and allows the drawer to be remotely filled and later joined to the engine for use in the cabinet.

Accordingly, the main object of this invention is a drawer-operating system that controls drawers in a cabinet by providing graduated access to a plurality of consecutively arranged bins. Other objects include a system that monitors the previous activity of a drawer to insure that emptied bins are bypassed in subsequent openings and that the next drawer opening will be to a bin containing items stored therein; a system that powers the drawer slightly open to allow subsequent manual opening to the appropriate item-filled bin; a system that reduces the shocking effect of slamming of the drawer into the cabinet during closing so that other items stored in the drawer and the rest of the cabinet are protected against shock; a system that can be utilized in a larger drawer-sized opening to take the place of a drawer used in a cabinet of the type shown in U.S. Pat. No. 5,014,875; a system that provides manual opening in the case of a power failure; a system that permits the drawer to be loaded with supplies and sealed against theft and opened for use at the cabinet to replenish exhausted supplies; and, a system that immediately locks the drawer in a safe position should the user attempt to jerk it open in an effort to obtain access to items in the rear of the drawer.

These and other objects of the invention will become more apparent when reading the description of the preferred embodiment along with the drawings that are appended hereto. The protection sought by the inventor may be gleaned from a fair reading of the claims that conclude this specification.

DESCRIPTION OF THE PREFERRED EMBODIMENTS

Figure 1:
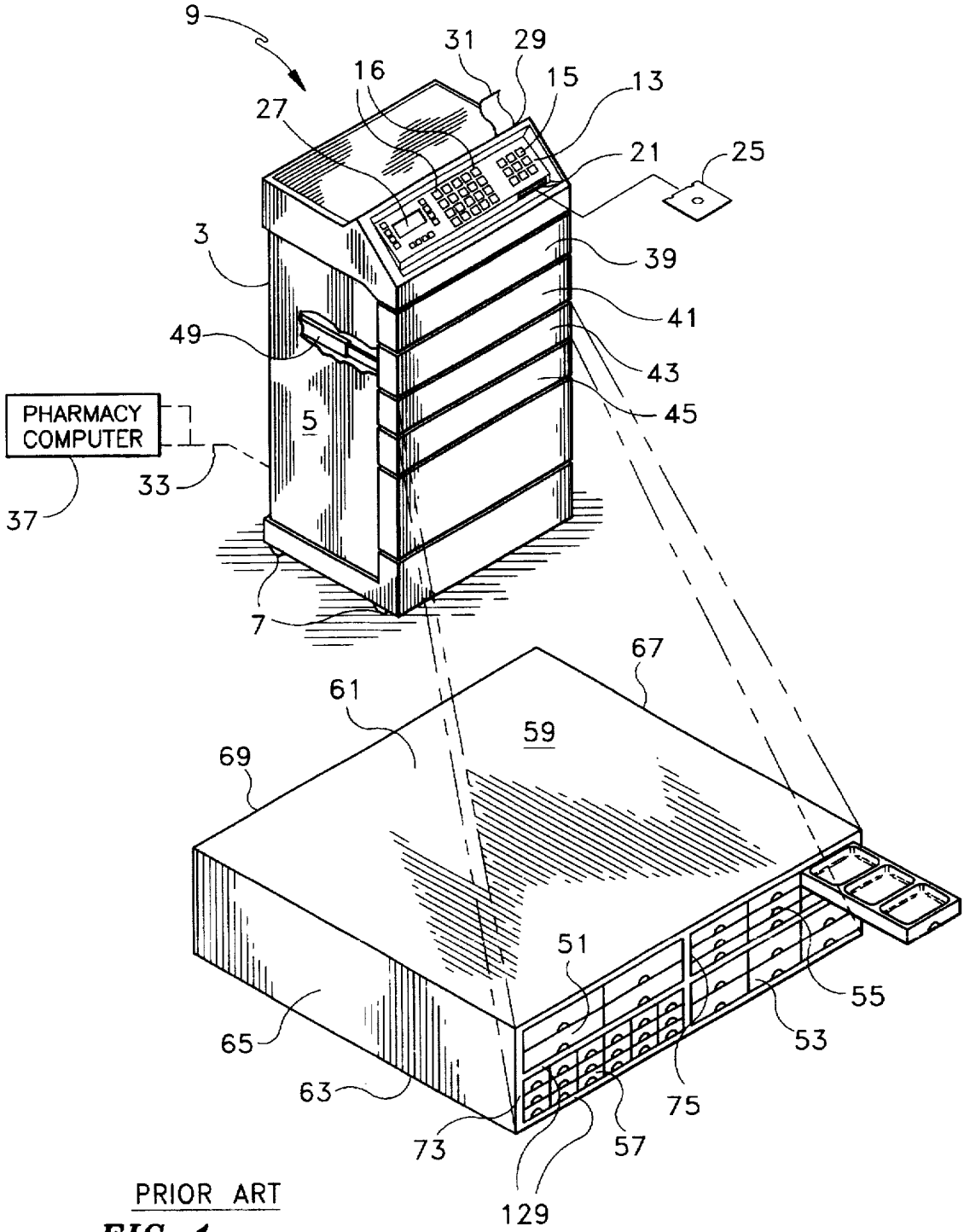
PRIOR ART FIG 1
FIG. 1 is an illustrative view of a prior art pharmaceutical item dispenser station showing this invention used in place of one of the drawers thereof.

Turning now to the drawings wherein like elements are identified with like numerals throughout the fifteen figures, FIG. 1 shows the invention 1 utilized in a drawer module for use in a medical dispenser station of the type disclosed and claimed in U.S. Pat. No. 5,014,875.

Figure 2:
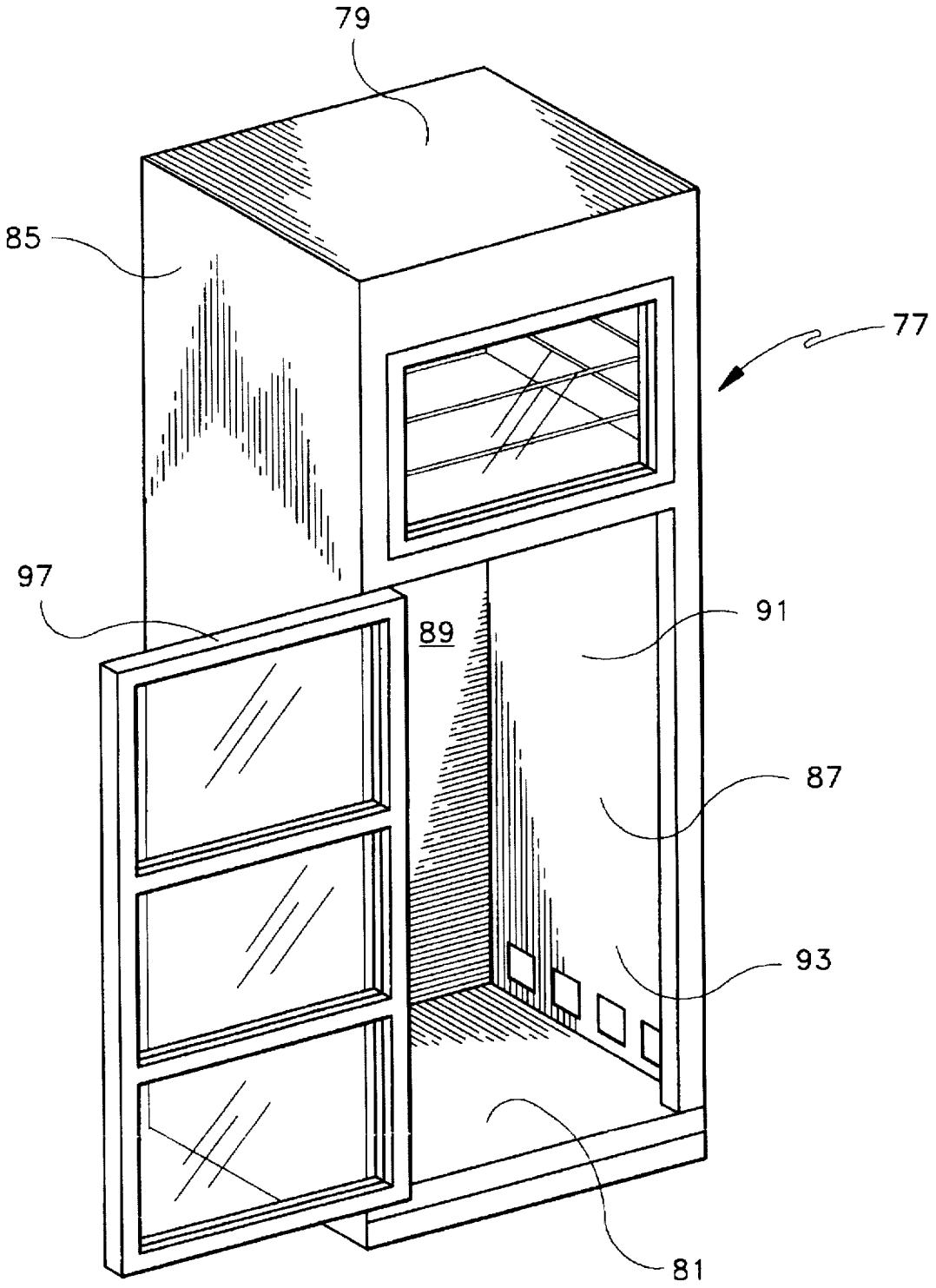
FIG. 2 an illustrative view of a prior art supply cabinet wherein this invention may be placed for utilization.

FIG. 2 shows the invention utilized in an auxiliary storage and dispensing unit of the type disclosed and claimed in U.S. Pat. No. 5,346,97. The invention may also be used in a wide variety of other configurations and the description here should not be taken as limiting the utilization of the invention in any way.

FIG. 1 shows the typical prior-art dispenser station 3 to compromise a compact cabinet 5 which may be supported on wheels 7 for convenient portability. A control unit 9, designed for quick and easy access and relatively easy keyboard entry of appropriate pre determined authorization access codes and other information, is mounted generally within the upper extent of cabinet 5 and includes a keyboard 13. Keyboard 13 includes an array of keys 13 or similar entry devices for entering information, in conjunction with a display, which utilizes liquid crystal elements or the like in programmed interaction with entered information.

Figure 3:
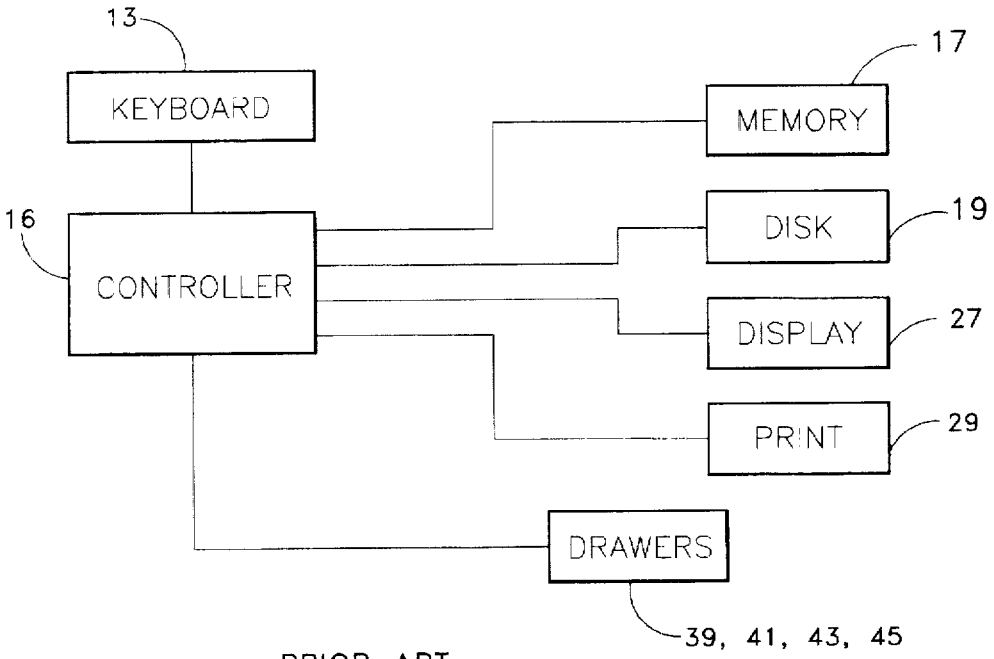
PRIOR ART FIG. 3
FIG. 3 is a block diagram of the logic used in the utilization of stations and cabinets that use this invention.

FIGS. 1 and 3 depict a controller unit 16 in schematic form with keyboard 13, for processing information controller 16 is programmed to regulate access to the station drawers and to generate an access record which is stored in an internal memory 17 or via a disk drive having an exposed disk port 1 to receive a conventional disk 25. Alternatively, the access record can be displayed on the cabinet display 27 and/or otherwise printed by means of an integral printer unit 29 for appropriate printout onto paper 31.

Controller 16 is preprogrammed with appropriate information regarding the medication types associated with a group of controllers assigned to station 3. In a preferred form, this programming occurs by virtue of a data link 33 which interconnects station 3 to a main computer such as a pharmacy computer 37 of the type used commonly in a centralized hospital pharmacy to track patient requirements for medication and other pharmaceutical items. In this regard, pharmacy computer 37 desirably includes appropriate software for programming and updating a group of dispenser stations located at centralized sites throughout a hospital facility thereby permitting regular updating of each dispenser station according to the most current patient information.

As shown in FIG. 1, dispenser station 3 includes a stack of four drawers labelled 39, 41, 43 and 45. Drawer 41 has a generally conventional drawer geometry and is mounted on slides 49 for sliding movement with respect to station housing 3. While the instant invention applies to single drawers housed in a cabinet, it also applies to an array or plurality of drawers housed in a cabinet the size of, and that takes the place of, one or more drawers 39–45. This array can be in groups of smaller or mini-drawers of four (51), six (53), nine (55) and eighteen (57). The housing 59, wherein this array of mini-drawers is contained, comprises spaced-apart top and bottom sheet metal or molded plastic walls 61 and 63 respectively, held in place by spaced-apart similarly constructed side walls 65 and 67 and a rear wall 69, all said walls joined along their respective contacting peripheral edges. A front wall 73 covers over housing 59 and has a plurality of rectangular openings 75 formed therein through which the drawers 51–57 pass during opening and closing.

This same housing can be used in an auxiliary storage and dispensing unit as disclosed and claimed in U.S. Pat. No. 5,346,297. As shown in FIG. 2, this unit comprises a tall cabinet 77 made up of spaced-apart top and bottom panels 79 and 81 respectively, joined about three marginal edges by spaced-apart side panels 85 and 87 respectively, and a rear cabinet panel 89 integrally connected along their mutually adjacent marginal edges such as by welding or other secure fastening. Panels 79 through 89 define an interior dispensing cavity 91 accessible through a front opening 93 covered over by a door 97. Housing 59 may be fitted in cavity 91 or in any subcompartment formed therein.

Figure 4:
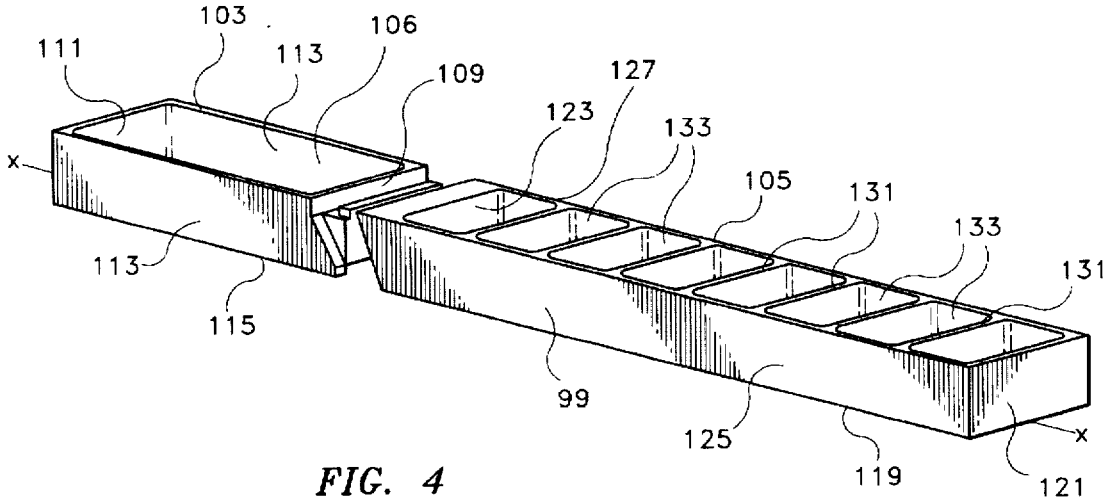
FIG. 4 is an illustrative view of the preferred embodiment of the invention.

As shown in FIG. 4, the mini-drawer 99 of this invention comprises two basic parts, an "engine" 103 and a "dispensing drawer" 105. Engine 103 is located to the rear of dispensing drawer 105 and the two operate as a complete power-controlled drawer for insertion in housing 59 through front wall opening 75. Engine 103 is bounded by an engine enclosure 106 comprising vertically oriented, spaced-apart front and rear walls 109 and 111 respectively, held apart by a pair of spaced-apart upwardly extending side walls 113, and supported on the bottom by a flat pan 115. Optionally, a top cover plate (not shown) may be used. All said walls and pan are attached together along their marginal edges, or more preferably molded as a single unit.

Figure 9:
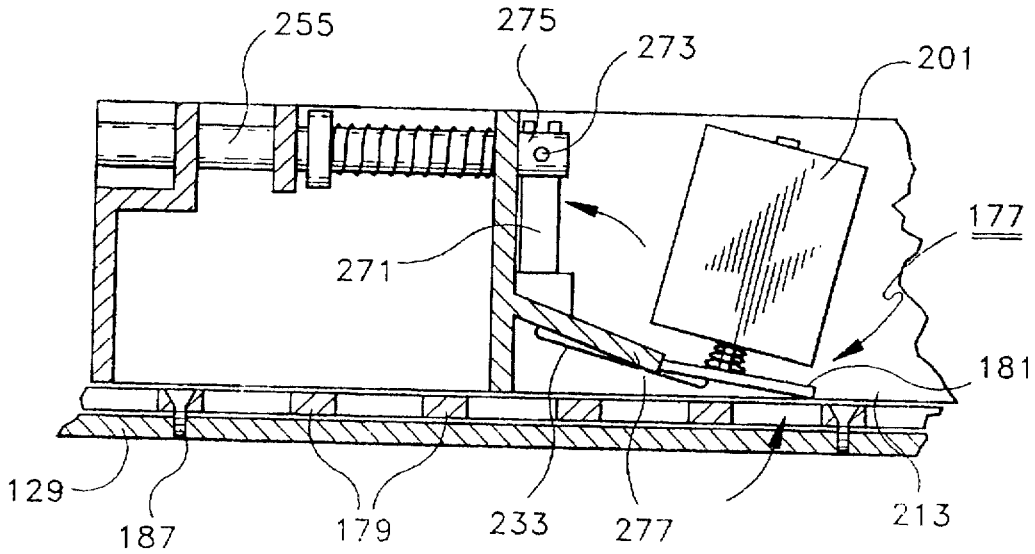
FIG. 9 is another side illustrative view, partially in section, drawer jerk-resistant locking portion of this invention showing it in the unlocked configuration.

Dispensing drawer 105 is shown in FIG. 4 to comprise an open top enclosure that includes an elongated bottom plate 119 which supports vertically oriented and spaced-apart front and rear walls 121 and 123 respectively, as well as spaced-apart side walls 125 and 127, all said walls attached together at their intersecting marginal edges or molded as a single unit that is supported on and rides along a cabinet dividing base or drawer support surface 129 (see FIG. 9.) A plurality of transverse walls 131 is formed in drawer 105 in consecutive spaced-apart arrangement from front wall 121 to rear wall 123 forming a plurality of open top bins 133 aligned coincident with the axis x—x of the sliding motion of said drawer into and out of housing 59 through front wall 73.

Figure 5A:
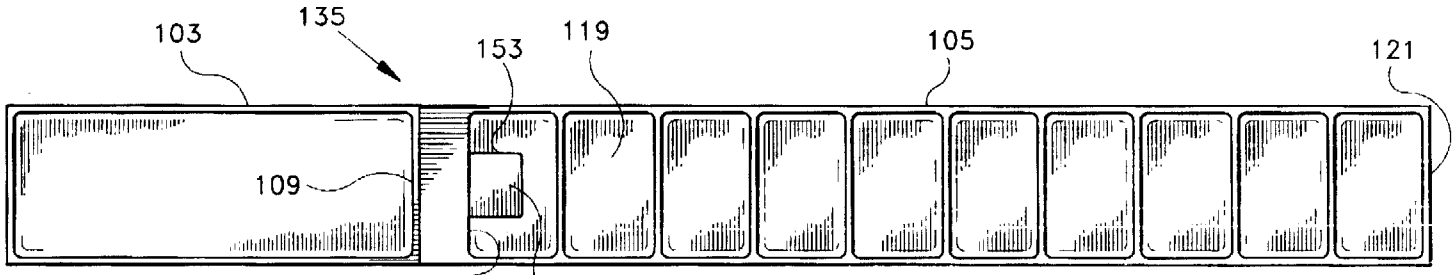
FIG. 5*a* is a top illustrative view of the embodiment shown in FIG. 4.
Figure 5B:
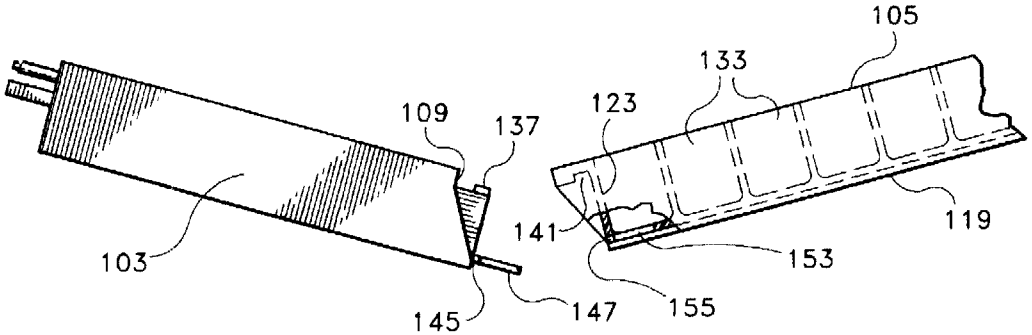
FIG. 5*b* is a side illustrative view of the same embodiment; and, FIG. 5*c* is a schematic view of the way the dispensing drawer in FIGS. 5*a* and 5*b* are connected to the engine in the same figures.
Figure 5C:
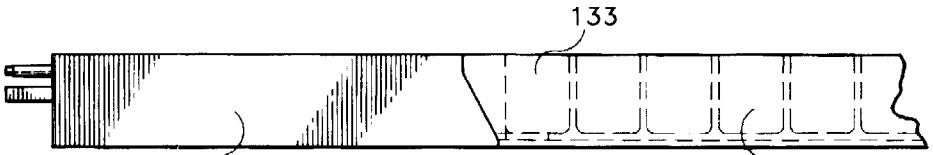

A unique feature of this invention is shown in FIGS. 5*a*, 5*b* and 5*c* where drawer 105 is shown to be connectable to the front of engine 103 through a coupling 135. Coupling 135 is shown to comprise an upwardly and rearwardly directed hook 137 attached to engine front wall 109, preferably above the center line or central axis x—x thereof. Hook 137 is formed in front wall 109 for receipt in a hook-receiving opening 141 formed in drawer rear wall 123. Extending forward from the bottom of engine housing front wall 109 is a connector arm 145. A rectangularly-shaped latch 147 terminates connector arm 145. A latch-receiving aperture 153 is formed in bottom plate 119, inboard from drawer rear wall 123 and is opened through rear wall 123 by a passageway 155.

As shown in FIGS. 5*b* and 5*c*, when engine 103 is pitched downward slightly at front wall 109 and drawer 105 is pitched upward slightly at rear wall 123, and hook 137 on engine rear wall 109 is inserted in hook-receiving opening 141, and then both drawer 105 and engine 103 are rotated toward a flat surface, as shown in FIG. 5*c*, connector arm 145 enters passageway 155, and latch 147 snaps into aperture 3 and becomes part of the floor of bin 133 that is located inside drawer rear wall 123 to temporarily lock engine 103 to dispensing drawer 105 in end-to-end fashion.

This is a unique aspect of the invention because it now means that dispensing drawers may be pre-loaded at a distance from cabinet 5, such as in a hospital pharmacy, the open top of bins 133 possibly sealed with a removable covering and then brought to and loaded into the cabinet and the seal removed. This reduces downtime at cabinet 5 and allows persons to merely pick up a sealed dispensing drawer, remove the top sealing film, if any, and load it directly into the dispensing drawer while simultaneously attaching it to engine 103.

To remove an empty drawer 105 from cabinet 5, latch 147 is merely pressed downward with the finger through aperture 153 and the drawer and engine pitched upward at coupling 135 to uncouple drawer 105 from engine 103. The close-fitting tolerances of latch 147, in latch-receiving aperture 153, retains dispensing drawer 105 in tight contact with engine 103.

Figure 6:
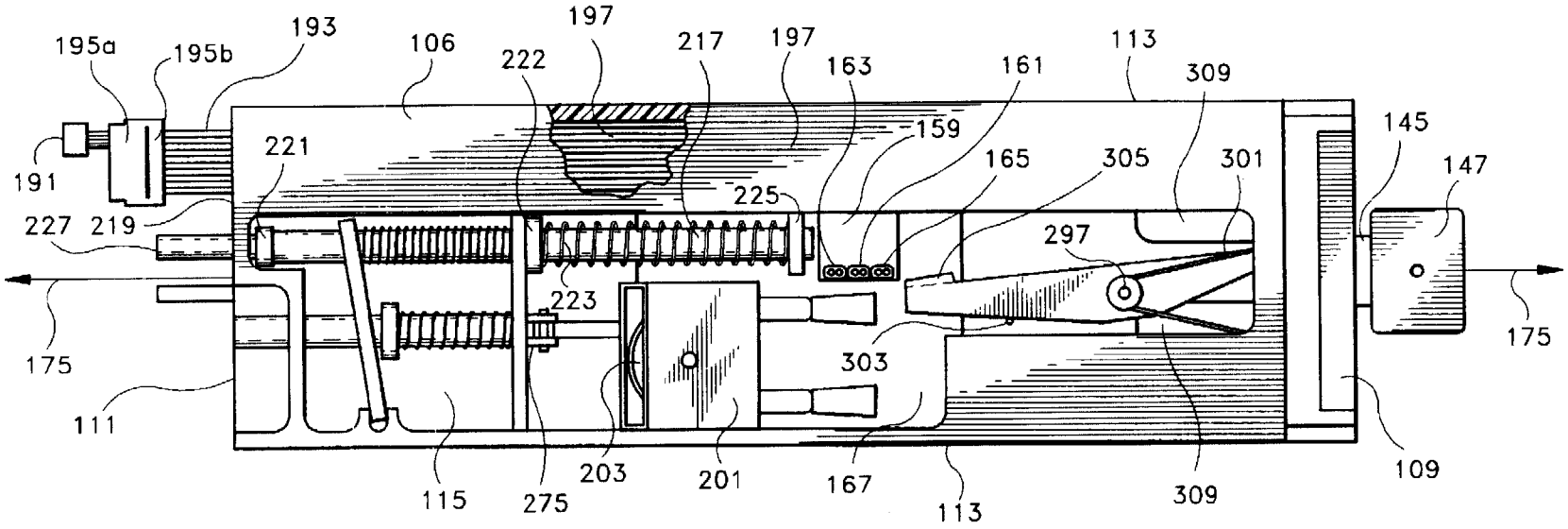
FIG. 6 a top illustrative view of the preferred embodiment of the invention showing the components and how they are arranged.
Figure 7:
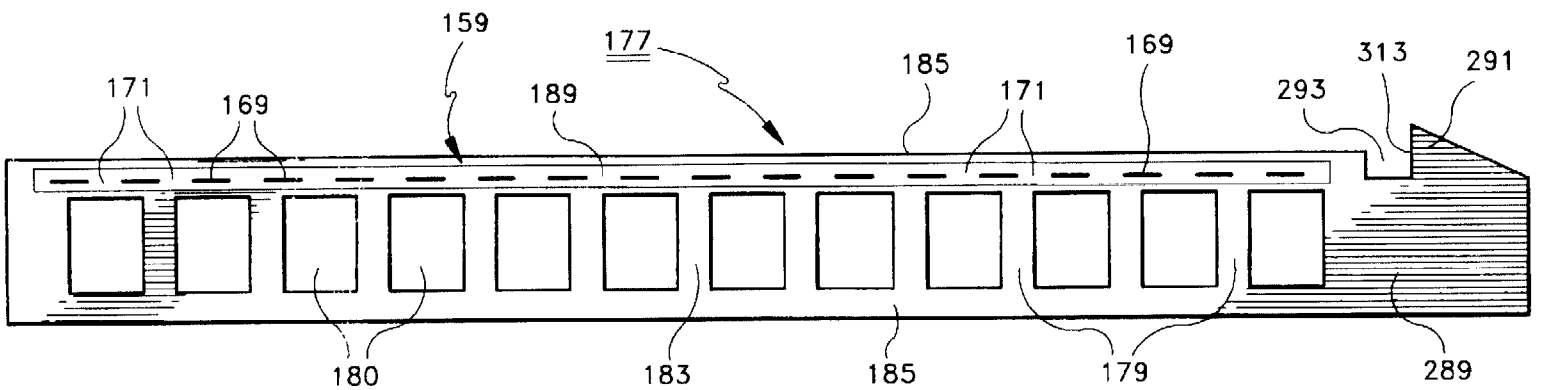
FIG. 7 is a top plan view of the ladder which is a part of the linear encoder of this invention.

As shown in FIGS. 6 and 7, a linear encoder 9 is provided in this invention and comprises a radiation source 161 and a pair of radiation receivers 163 and 165, the latter two preferably in close, spaced-apart arrangement and aimed downward in engine enclosure 106 through an aperture 167 formed in flat pan 115. Also as part of encoder 159 is at least one plurality of reflective areas 169 and non-reflective areas 171 arranged in a consecutive line or order under drawer 99 and spaced alternately along cabinet base wall 129 where drawer 99 moves along its path 175 during opening and closing in cabinet 5.

Figure 8:
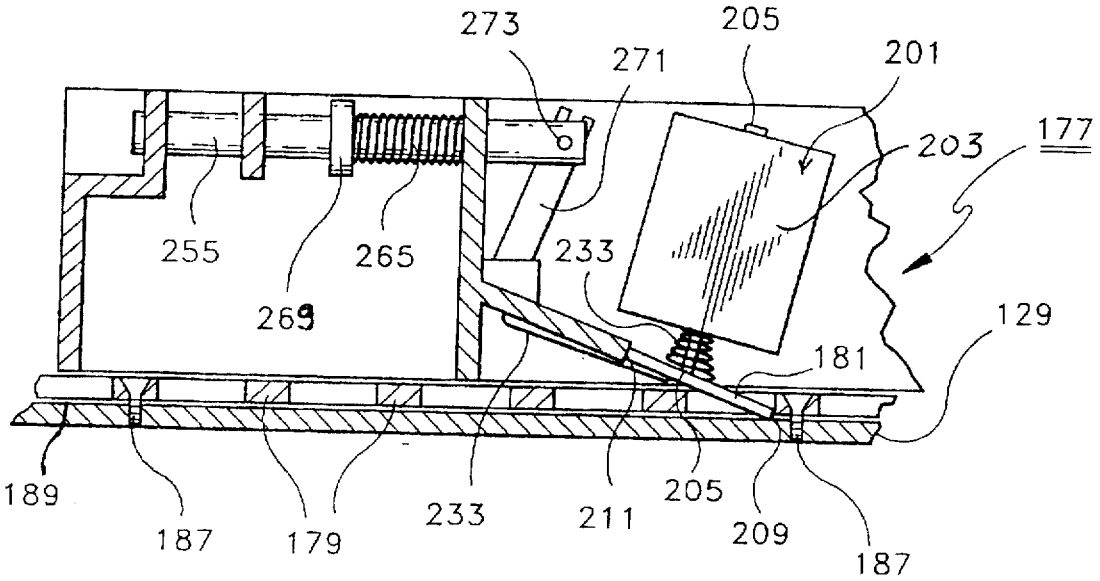
FIG. 8 is a side illustrative view, partially in section, of the drawer jerk-resistant locking portion of this invention showing it in the locked configuration.

Radiation source 161 emits a beam of radiation, preferably in the ultraviolet range, downward through aperture 167 that strikes reflective and non-reflective surfaces 169 and 171 to provide a scattered return. Radiation receivers 163 and 165, spaced-apart from source 161 and from each other, receive some of the reflected radiation as drawer 99 moves along its path. The radiation receivers provide data used to determine the velocity of drawer 99 during its opening movement and its closing movement as well as its exact position in cabinet 5 at any given time. Further, the arrangement of receivers 163 and 165 also allows determination of the rate of change of velocity as drawer 99 is being pulled open. Two pluralities of areas 169 and 171 may be employed, as shown in FIG. 7, in spaced-apart arrangement. This extra or additional information is necessary to operate the drawer-opening mechanism and to prevent someone from attempting to by-pass the authorized opening distance of the drawer by trying to jerk it open to an extended opening for unauthorized access to deeper parts of the drawer A drawer stop means 177 is shown in FIGS. 7–9 to comprise a plurality of cross-arms 179 set in consecutive order for contact with a trigger 181, as will be hereinafter more fully explained. Cross-arms 179 are preferably in the form of raised surfaces into which trigger 181 will drop and prevent drawer 99 from opening further. In the preferred embodiment shown in FIG. 7, drawer stop means 177 is in the form of a horizontal ladder 183, comprising a pair of side arms 185, arranged in spaced-apart relationship, and joined together by said plurality of the aforesaid cross-arms 179, leaving a plurality of apertures 180 in sequential order in the general form of a ladder, said ladder punched or stamped out of a piece of metal, such as steel, having a thickness of about 1/16 of an inch, and fastened to drawer support surface 129 by screws 187. Conveniently, linear encoder reflective areas 169 and non-reflective areas 171 are formed into thin paper or metal foil encoder strips 189 and are glued or otherwise attached along one side arm 185 of ladder 183 directly below the intake slot or eye of radiation receivers 163 and 165.

A controller 191 (see FIG. 6) is mounted apart from engine enclosure 106 and is connected to radiation receivers 163 and 165 by a wire cable 193 and mateable plug halves 195*a* and 195*b*, said cable carried in folded condition in a trough 197.

Controller 191 contains a read only memory (ROM), a random access memory (RAM), and other computer subcomponents (not separately shown) that work, in conjunction with a software program, to initiate, control and terminate certain functions of this invention. Controller 191 receives the electronic signals from linear encoder 159 and other information from controller unit to allow drawer 99 to be pulled open a controlled distance for access to a partially or fully-filled bin 133.

As shown in Figures, an electrically-operated solenoid 201 is mounted in engine enclosure 106 and includes a solenoid coil 203 and a plunger 205 reciprocally mounted therein. Trigger 181, including a front edge 209, is attached to plunger 205 and arranged for pivotal movement, about a hinge 211, over an opening 213 formed in engine compartment pan 115, to be lowered into contact with cross-arms 179 to stop the withdrawal movement of drawer 99.

The arrangement of linear encoder 159, drawer stop means 177, and solenoid 201, with their associated hardware hereinbefore described, is only one of such engine arrangements. Other engine arrangements would be where linear encoder 159 is mounted on drawer 99, drawer stop means 177 is mounted in cabinet 5 and solenoid 201 is mounted on or in cabinet 5. All of these arrangements are fully contemplated in this invention and the above description should not be taken in any way as limiting the scope and spirit of this invention.

It is an object of this invention that pharmaceuticals and other medical supplies are stored in each bin 133 in mini-drawer 99 and the drawer is opened only far enough to allow these materials to be extracted from the first full or partially full bin therein. As the supplies are extracted, and the bins emptied, the drawer is allowed to be pulled open further and further to allow access to bins located deeper in the drawer. Controller 1 receives information, each time drawer 99 is opened, so that a running count is made of the materials extracted and of the materials remaining in bins 133 to which access has not yet been given. Upon subsequent opening of any particular drawer 99, this invention has the function of allowing unrestricted withdrawal of the drawer from cabinet 5 to a position exposing all empty bins 133, from which material and supplies have already been extracted, and stopping only when a first full or partially full bin 133 is exposed.

This invention also has the function of moving the appropriate mini-drawer 99 open a short distance out of cabinet 5 to provide the user with a visual indication that this particular drawer contains the items he or she desires. This is in marked contrast to the prior art device disclosed in U.S. Pat. No. 5,392,951 wherein a spring is used to power the drawer all the way from its fully-closed position to its fully-open and controlled position. It is not the practice of this instant invention to provide means for linearly moving the drawer to the fully-open position; it is left to the user to manually open the drawer after it is partially opened.

Figure 10:
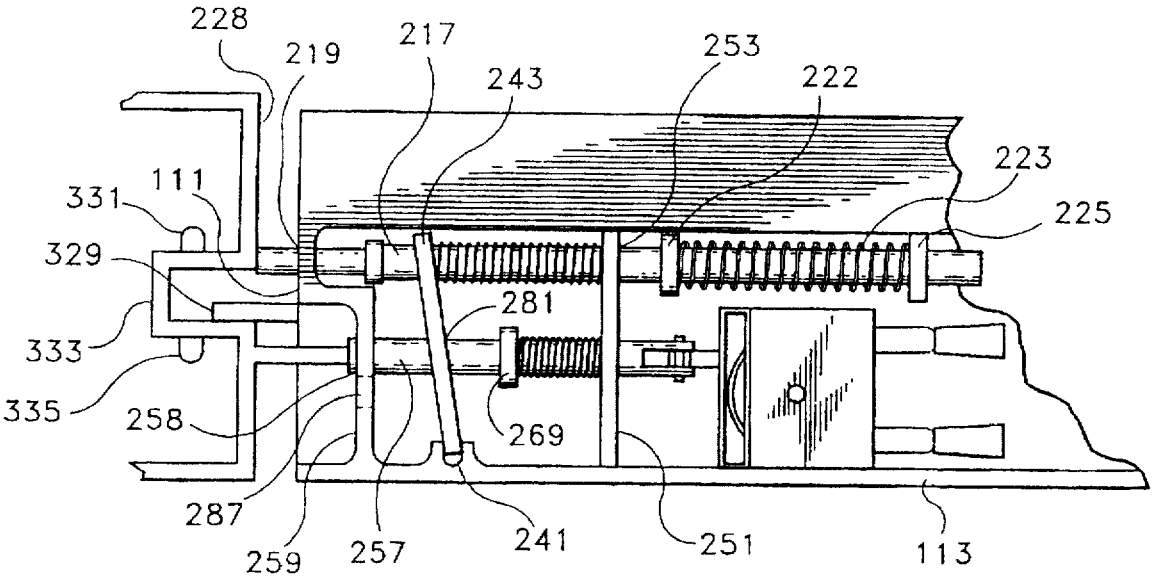
FIG. 10 is a top view of the mechanism locking the drawer in storage in the cabinet.
Figure 11:
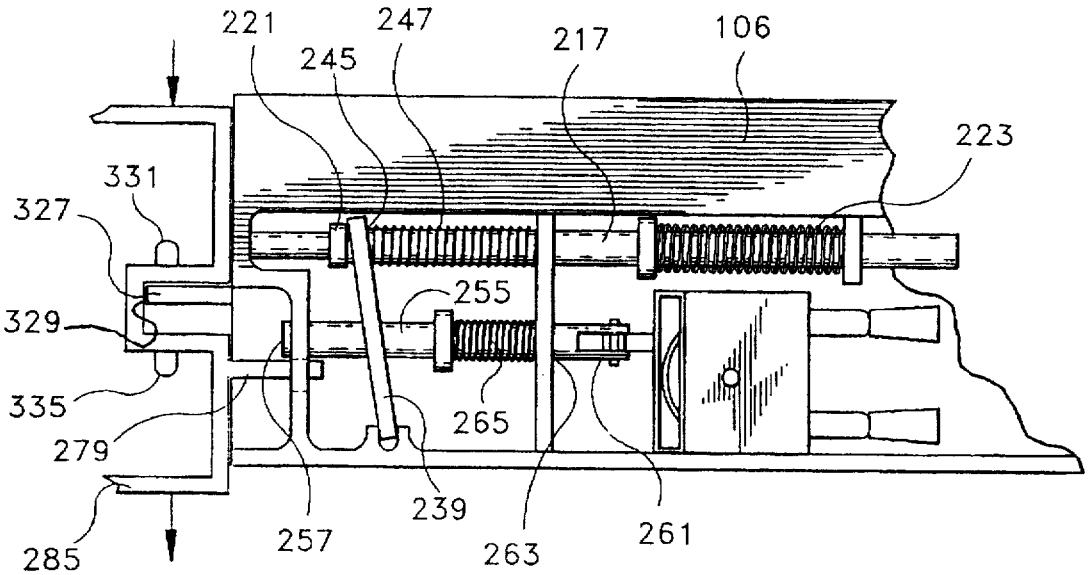
FIG. 11 is an illustrative view of the emergency release lever used to release a plurality of drawers from locked storage in the cabinet in the event of a power failure.

To provide this function FIGS. 10 and 11 show, a shaft 217 is slidably mounted in engine enclosure 106 for reciprocal motion, in the direction of drawer movement along path 175 in and out of cabinet housing 59, and passes through a first aperture 219 formed in rear engine wall 111, as shown in FIGS. 6 and 10. A first collar 221 is attached to shaft 217 to block rearward motion of said shaft to a controlled extent. A first spring 223 is formed around shaft 217 and is captured between a second collar 222 on shaft 217 and an apertured tab 225, through which shaft 217 is supported and passes. Each time mini-drawer 99 (engine enclosure 106) is closed into the cabinet, the rear terminal end 227 of shaft 217 strikes a portion of rear housing wall 228 and spring 223 is partially compressed. At the same time, trigger 181 is forced by a spring 233, stretched about solenoid shaft 205, into a downward position in locked engagement with cross-arms 179 (as shown in FIG. 8) and locks drawer 99 into closed position in housing 59 or the cabinet in which it is housed. Upon input of appropriate information in keyboard 13, controller unit 16 provides electronic signals to controller 191 and said controller energizes solenoid 201 to raise solenoid plunger 205 and pull trigger 181 out of contact with cross-arm 179. Thereupon, spring 223 is released from its constraints and allows shaft 217 to push drawer 99 open approximately one inch. Thereafter, the user manually pulls drawer 99 open using a front-mounted drawer handle 231.

In operation, upon receipt of the appropriate information via keyboard 13, solenoid 101 is activated by controller 191 and plunger 205 raises trigger 181 from interference or abutment against cross-arm 179 and spring 223 moves shaft 217 against cabinet rear wall 228 to move drawer 99 outward from the front wall of the cabinet, about an inch. The user then manually pulls the drawer further open using drawer handle 231 until controller 191 determines, from information programmed into its control unit 9 and from signals received from linear encoder 159, that the appropriate bin 133 has been uncovered. At this point, solenoid 201 is de-energized and spring 223 drives plunger 205 and trigger 181 downward into jamming contact with one of cross-arms 179 and prevents further opening of drawer 99.

Upon finishing removal of the items from bins 133 in drawer 99, the user begins to close it. Linear encoder 159 immediately determines the rearward movement of drawer 99 and signals controller 191 to energize solenoid 201 to raise plunger 205 and trigger 181 against the bias pressure of spring 223, out of contact with cross-arm 179 to allow drawer 99 to be closed. Linear encoder 159 determines when drawer 99 is about to reach full closure and signals controller 191 to de-energize solenoid 201 and allow spring 223 to bias trigger 181 back into contact with a cross-arm 179 to hold drawer 99 in locked position in cabinet 5. The compression of spring 223 during the final few centimeters of closing drawer 99 in cabinet 5 places a forward bias pressure on drawer 99 and reduces the incidence of slamming drawer 99 in cabinet 5. This compression of spring 233 provides the potential energy available to re-open drawer 99 approximately an inch, as aforesaid, the next time it is programmed to be opened. Accordingly, spring 223 serves a dual purpose in not only preventing or reducing the destructiveness of slamming a drawer closed, but also of storing potential energy necessary to partially open drawer 99 on its next programmed opening.

Any effort by the user to quickly pull the drawer outward, during drawer closure, or pull it quickly outward at any time will be noticed by linear encoder 159, using the calculated rate of change of acceleration from data furnished by radiation receivers 163 and 165 in picking up the passage of the radiation reflected from radiation surfaces 169. That information is used to signal controller 191 that will, in turn, determine that the rate of change of acceleration of the drawer has exceeded a pre-set value. Such information will immediately generate a signal to de-energize solenoid 201 and allow spring 233 to immediately push plunger 05 downward and drive trigger 181 into jamming relationship with a cross-arm 179. A visual or oral alarm, such as a message: "YOU HAVE PULLED THE DRAWER OPEN TOO RAPIDLY. PLEASE CLOSE THE DRAWER AND PULL IT OUTWARD MORE SLOWLY" may be programmed to appear on cabinet display 27 or other display or broadcast by electronic voice, to warn the user that h is or her activity has exceeded allowable tolerances.

Power failures are not uncommon in areas where this inventive device is useful. This invention contains the function to allow access to the drawers in the event of such an occurrence. As shown in FIGS. 10 and 11, a lever 239 is pivotally mounted at one end by a hinge pin 241 on engine side wall 113 and extends across engine enclosure 106 terminating at a distal end 243. Lever 239 has a second aperture 245 formed near distal end 243 through which shaft 217 passes. A second spring 247 is wrapped about shaft 217 and extends between hinge pin distal end 243 and a support wall 251 which forms a third aperture 253 through which shaft passes in reciprocal motion.

Second spring 247 is held in a partially compressed state between lever 239 and support wall 251 and the movement of shaft 217 during normal closure of drawer 99 serves not to disturb this partially compressed state. Further closure is prevented by a second shaft 255 spaced-apart from first shaft 217 in engine enclosure 106 and supported near its rear terminal end 257 by an aperture 258 formed in inset portion 259 of rear engine wall 111 and further supported near its front terminal end 261 by support wall 251 having an aperture 263 formed therein through which said second shaft 255 passes.

A spring 265 is wrapped about shaft 255 and captured between a collar 269, formed on shaft 225, and support wall 251. As shown in FIGS. 8 and 9, a pivot arm 271 is connected by a pin 273 to shaft front terminal end 275 and extends downward and is pinned to an arm 277 extending from trigger 181. When drawer 99 is closed against cabinet front wall 73, and shaft spring 223 is partially compressed against housing rear wall 228, second shaft rear terminal end 257 bottoms against a pin 279 extending forward from cabinet rear wall 228 (see FIGS. 10 and 11). This forward movement of shaft 269 causes pivot arm 271 to lift arm 277 thereby pivoting trigger 181 about hinge 211 and driving trigger front edge 209 down into jamming contact against cross-arm 179. This locking or jamming feature prevents any drawer from being pulled open because trigger 181 is placed in jamming contact with a cross-arm 179 when drawer 99 is closed against cabinet front wall 73.

As shown in FIGS. 10 and 11 second shaft 225 passes through an aperture 281 formed in lever 239, between hinge pin 241 and lever distal terminal end 243, wherein the tolerances for aperture 281 are set close to the outside diameter of second shaft 225. This results in a jamming condition existing between lever 239 and second shaft 255 when lever 239 is biased rearward by second spring 247. This jamming condition holds second shaft 255 in a forward, and preferably in a forwardmost, configuration with spring 265 being heavily compressed.

Upon the occurrence of a power failure, the drawers remain locked in the cabinet and cannot be accessed by anyone. To place the drawers in a releasable configuration, a lever or other graspable element 285, preferably located at the rear of cabinet 5, is displaced, either by moving it outward, inward, upward, downward, or to one side or the other. This movement displaces pin 279 to one side of second shaft rear terminal end 257 and into alignment with an aperture 287 formed in inset wall portion 259. Prior to this situation occurring, drawer 99 could not be pushed into cabinet 5 any further, in its closed configuration, because of the abutting of pin 279 against second shaft rear terminal end 257 that was fully displaced in its forwardmost position. Now, with the removal of pin 279 from that abutment position, the user may open any drawer by merely pushing the drawer inward a short distance, for example, ¼ of an inch, to push first shaft 217 slightly forward so that collar 221 comes into contact with the rear side of lever 239. The slightly forward movement of collar 221 against lever 239 pivots lever 239 forward about hinge pin 241 and releases the jamming contact between second shaft 225 and lever 239. Immediately, the loss of jamming contact allows second shaft 225 to trip out of its jammed condition and move rearward thereby straightening pivot arm 271 to press 9 downward on arm 277 and pivot trigger 181 about hinge 211 and out of jamming condition with cross-arm 179.

In operation, upon the occurrence of a power failure, the exterior of cabinet 5 remains absolutely unchanged. The displaced movement of lever 285, preferably at the rear of cabinet 5, still does nothing to change the exterior configuration of cabinet 5. However, any drawer that is to be opened may be opened by merely pressing against the drawer and displacing it slightly into cabinet 5. When releasing pressure on the drawer, it will be propelled by spring 223 outward approximately an inch to an inch-and-a-half and may be opened to extract the contents from any of the bins. However, when that particular drawer is pushed closed, it will not lock in cabinet 5 but will remain unlocked and positioned outward approximately one inch to an inch-and-a-half and remain in that configuration until power is restored. Once power is restored and lever 285 moved back to its original position, all the drawers in cabinet 5 will once again be securely locked, except for the drawer or drawers that were open during the power failure by pushing the drawer slightly inward as aforesaid. Accordingly, this unique feature of the invention permits a ready observation of what drawers have been opened during a power failure and the security of the contents in those particular drawers may be assessed. Should lever 285 not be moved during a power failure, then, upon the resumption of power, cabinet 5 will continue to remain totally locked and secure from unwanted entrance.

One of the overriding considerations of this invention is that it provides controlled access to the materials stored in the bins of each drawer. Accordingly, it is necessary to insure the continued security of the cabinet and of the items stored therein during transient periods when one or more mini-drawers 99 are removed therefrom for purposes of loading new supplies in the bins formed therein, either at the site of cabinet 5 or at a remote location. As previously disclosed, the entire mini-drawer 99 is comprised of an engine 103 attached in a nose-to-tail arrangement with a dispensing drawer 105 with engine 103 at the rear of the arrangement. When dispensing drawer 105 is removed from cabinet 5, through the use of coupling 135, engine 103 remains in cabinet 5. It is imperative that engine 103 not be able to be removed or pushed inward cabinet 5 to create an accessible opening into the interior of cabinet 5 while at the same time it is imperative to be able to remove engine 103 from cabinet 5 for purposes of maintenance, etc., upon demand.

Figure 12:
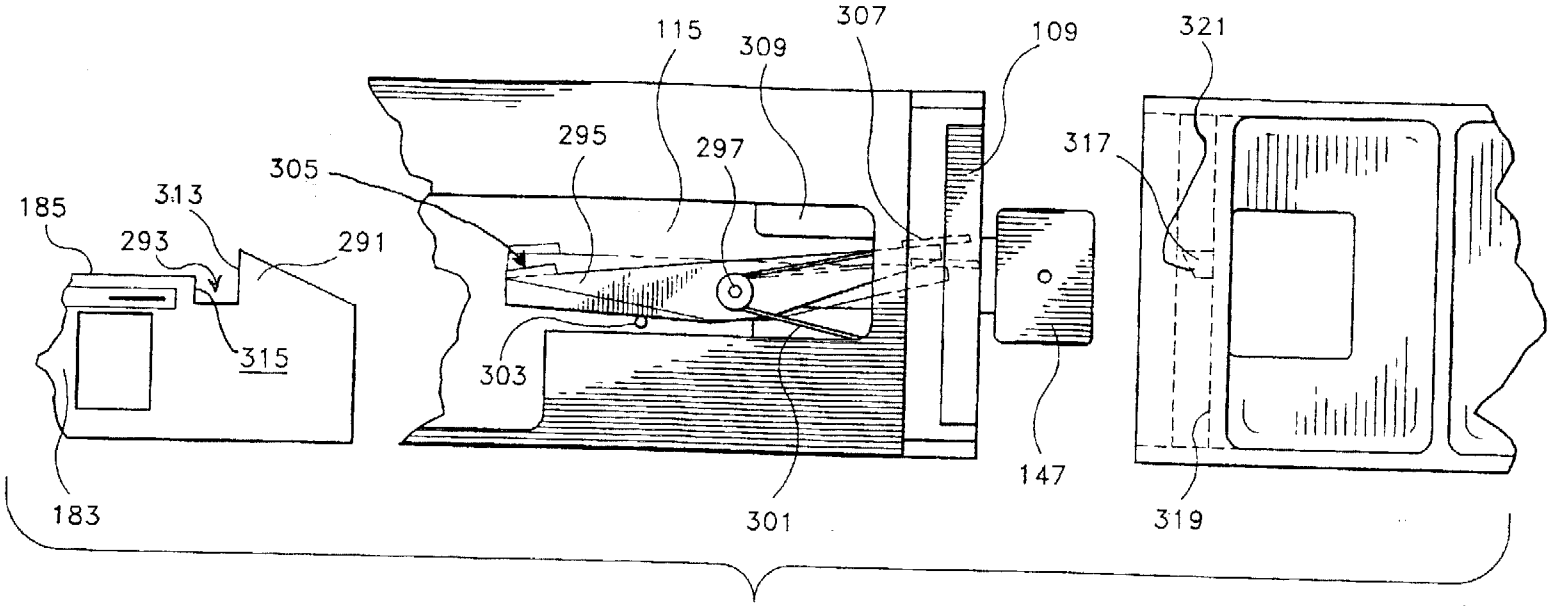
FIG. 12 is a top, illustrative view of the engine-release mechanism.

A unique feature of this invention is shown in FIGS. 7 and 12 wherein ladder 183 terminates, at its forwardmost end 289, in a hook 291 and relief area 293. In the forward end of engine enclosure 106 is a latch 295 pivotally mounted by a center pin 297 on engine pan 115 and biased by a spring 301 into a counterclockwise position and retained therein by a pin 303 extending upward from flat pan 115. A trigger 305 extends downward from the rear of latch 295 while a tab 307 extends upward from the forward part of latch 295 inboard of engine front wall 109. An aperture 309 is formed in engine front wall 109 near tab 307 to provide access forward of engine 103 to said tab by virtue of a tool such as a screwdriver (not shown).

In operation, and when engine 103 is attached in end-to-end fashion with dispensing drawer 105 at coupling 135, upon the full withdrawal of dispensing drawer 105, trigger 305 comes into contact with the rear wall 313 of hook 291 that extends further outward from ladder 183 than side arms 185. This contact prevents anyone from pulling engine 103 out of cabinet 5. Engine 103 may be removed through the front of cabinet 5 by first disconnecting drawer 105, as previously disclosed, and secondly by inserting a screwdriver or other such tool into aperture 309 and moving tab 307 to the left thereby pivoting trigger 305 clear of hook 291 and withdrawing said engine using latch 147 as a handle.

In addition, and significantly important, is the fact that once drawer 105 is pulled out of cabinet 5 and disconnected from engine 103, engine 103 may not be pushed back into cabinet 5, so as to provide an opening for a small-handed person to reach into cabinet 5 and extract pharmaceuticals therefrom, because trigger 305 is displaced slightly in a counterclockwise direction during the uncoupling and any attempt to push engine 103 back into cabinet 5 will cause trigger 305 to come into contact with rear wall 315 of relief area 293 and bar such movement. A protrusion 317 extending rearward of the rear wall 319 of dispensing drawer 105 contains a ramp 321 that comes into contact with tab 307 during coupling of engine 103 with drawer 105. Ramp 31 pivots trigger 305 out of contact with relief rear wall 315 but not far enough to clear said trigger from hook 291 thereby allowing drawer 105 to be pushed, along with engine 103, back into its cavity in cabinet 5. This configuration prevents unwarranted entrance into cabinet 5 as hereinbefore set forth.

Figure 13:
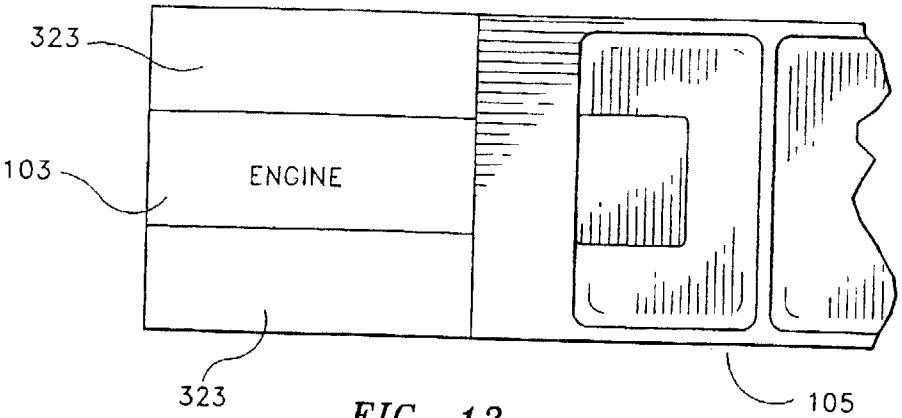
FIG. 13 is a top view of the components of the invention utilizing outriggers to center the engine in a wide drawer.

As shown in FIG. 13, engine 103 may be coupled with dispensing drawers 105 of different widths and heights to make engine 103 extremely versatile. As shown in FIG. 13, engine 103 is coupled with a dispensing drawer 105 having approximately three times the width of drawer 105 shown in FIGS. 5*a*, 6, 8, and 9. In this situation, engine 103 may be coupled along its sides with spacers or outriggers 323 as shown. Spacers 323 do not provide engine room or extra storage space, but merely render engine 103 compatible with the extended width of drawer 105.

As shown in FIGS. 10 and 11, a pin 327 extends outward a short distance from rear engine wall 1and terminates at a distal end 239. Pin 37 is positioned for the purpose of indicating when drawer 99 is fully closed in cabinet 5. This is done by arranging a radiation transmitter 331 on one side of a detent 333 in rear housing wall 228 and a radiation receiver 335 on the opposite side of detent 333 and allowing a beam of radiation to pass therebetween. When drawer 99 is fully closed into cabinet 5, pin 327 enters detent 333 and pin end 329 passes between radiation transmitter 331 and radiation receiver 335 to interrupt said beam, thereby indicating the position of mini-drawer 99 in cabinet 5. Upon interruption of the beam, solenoid 201 is energized through control unit 16 and controller 191 to advance trigger 181 into jamming position between cross-arms 179. This jammed, closed position of drawer stop means 177 remains as a primary drawer-locking system while bias spring 233 acts as a mechanical backup for the same function.

While the invention has been described with reference to a particular embodiment thereof, those shilled in the art will be able to make various modifications to the described embodiment of the invention without departing from the true spirit and scope thereof. It is intended that all combinations of elements and steps which perform substantially the same function in substantially the way to achieve substantially the same result are within the scope of this invention.

What is claimed:

1. A drawer operating system for controlling a drawer having a sliding direction, said drawer defined by a front end and a rear end and partitioned by walls into a plurality of bins consective with one another along the sliding direction for holding various dispensable items, said drawer housed in a cabinet and arranged to move between a closed position and graduated, progressively open positions to allow access to one or more bins and the contents stored therein, said system comprising:

a) a linear encoder for monitoring the position and direction of movement of said drawer, including the length of opening said drawer on its preceding excursion, and for producing a plurality of electronic signals specific to the position and movement of said drawer;

b) drawer stop means arranged between said drawer and said cabinet;

c) a controller for receipt of said electronic signals; and, d) an electronic solenoid, including a spring-loaded plunger slidingly mounted therein, for activation by said controller, after the beginning of the drawer-opening sequence, and during translational movement along said drawer stop means to drive a trigger attached thereto into contact with said drawer stop means to prevent said drawer from being manually opened beyond a certain distance out from said cabinet wherein a bin containing the items to be withdrawn is exposed.

2. The drawer operating system of claim 1 wherein said linear encoder produces signals for determining the instantaneous position of said drawer at any time.

3. The drawer operating system of claim 1 wherein said linear encoder produces signals for determining the instantaneous velocity of said drawer during manual opening thereof.

4. The drawer operating system of claim 1 wherein said linear encoder produces signals for determining the rate of acceleration of said drawer during manual opening thereof.

5. The drawer operating system of claim 1 wherein said linear encoder produces signals for determining the rate of change of acceleration of said drawer during manual opening thereof and, upon determination of a rate of change in excess of a certain value, signalling said controller to activate said drawer stop means to immediately prevent further opening of said drawer.

6. The drawer operating system of claim 1 wherein said linear encoder includes:

a) a first plurality of radiation reflective and nonreflective areas formed in aligned and consecutive alternating order;

b) a radiation source arranged apart from said areas to provide a beam of radiation for striking said reflective and non-reflective area in consecutive order during translational motion between said drawer and said cabinet; and, c) a radiation receiver arranged apart from said radiation source to receive a portion of the radiation beam reflected from said first reflective areas during translational motion between said drawer and said cabinet.

7. The drawer operating system of claim 6 wherein said linear encoder further includes:

a) a second plurality of radiation reflective and nonreflective areas formed in aligned and consecutive alternating order and not in alignment with said first plurality of areas;

b) a radiation source arranged apart from second areas to provide a beam of radiation for striking said reflective and non-reflective areas of said second strip in consecutive order during translational motion between said drawer and said cabinet; and, c) a radiation receiver arranged apart from said radiation source to receive a portion of the radiation beam reflected from said second reflective areas during translational motion between said drawer and said cabinet.

8. The drawer operating system of claim 6 wherein said first plurality of areas are formed on a strip attached to said cabinet adjacent said drawer and said first radiation source and first radiation receiver are mounted on said drawer.

9. The drawer operating system of claim 6 wherein said second plurality of areas are formed on a strip attached to said cabinet adjacent said drawer and said second radiation source and second radiation receiver are mounted on said drawer.

10. The drawer operating system of claim 6 wherein said first plurality of areas are formed on a strip attached to said drawer adjacent said cabinet and said first radiation source and first radiation receiver are mounted on said cabinet.

11. The drawer operating system of claim 6 wherein said second plurality of areas are formed on a strip attached to said drawer adjacent said cabinet and said second radiation source and second radiation receiver are mounted on said cabinet.

12. The drawer operating system of claim 6 wherein said first and second reflective and non-reflective areas are formed on strips and are set in spaced-apart arrangement and said drawer stop means comprises a plurality of cross-arms set in consecutive order between said first and second strips for contact with said trigger to halt the movement of said drawer during manual opening thereof.

13. The drawer operating system of claim 12 wherein said strips and said cross-arms are formed on a thin piece of metal and fastened to the surface on which said drawer slides.

14. The drawer operating system of claim 1 wherein said drawer stop means is mounted to said cabinet.

15. The drawer operating system of claim 14 wherein said array is selected from the group consisting of four drawers, six drawers, nine drawers and eighteen drawers.

16. The drawer operating system of claim 1 wherein said solenoid and said trigger are mounted to said cabinet.

17. The drawer operating system of claim 1 wherein said solenoid and said trigger are mounted to said drawer.

18. The drawer operating system of claim 1 further including a plurality of drawers housed in an array in a cabinet, each drawer arranged to move independently between a closed position and graduated, progressively opened positions to allow access to one or more bins and the contents stored therein.

19. The drawer operating system of claim 1 wherein said drawer stop means is mounted to said drawer.

20. The drawer operating system of claim 1 wherein said system is located at the rear of the drawer.

21. The drawer operating system of claim 1 further including a bolt for moving said drawer from its fully closed position to a partially open position, at the beginning activation of said drawer operating sequence, to provide a visual indication to the user as to which drawer is openable to expose the contents therein.

22. The drawer operating system of claim 1 wherein said controller includes means to receive signals from said linear encoder to determine the rate of change of acceleration of said drawer as it is started to be opened so that, should such rate of change of acceleration exceed a preset value, said controller will activate said solenoid to immediately stop said drawer from further opening.

23. The drawer operating system of claim 1 further including a monolithic container having a plurality of consecutively formed bins formed therein for insertion and locking into said drawer to provide the bins for holding the items to be dispensed.

24. A drawer operating system for controlling a drawer having a sliding direction, said system including a plurality of drawers housed in a cabinet, each said drawer defined by a front portion partitioned by walls into a plurality of bins consecutive with one another along the sliding direction for holding various dispensable items, formed therein for holding at least one pharmaceutical supply in each said bin, said drawer housed in a secure cabinet and arranged to move between a closed position and graduated, progressively open positions to allow access to one or more bins and the contents stored therein, said system comprising:

a) means for locating a drawer in the cabinet carrying the desired supply and causing said drawer to be unlocked from its secure position in the cabinet and moved open a short distance to indicate to the user that said drawer is the appropriate drawer for extracting the supply therefrom; and, b) drawer stop means arranged between the drawer and the cabinet and activated by said drawer locating means to allow the drawer to be manually pulled open a distance allowing access to the bins previously emptied of supplies and the first bin carrying supplies to be extracted therefrom;

c) said locating means comprising a controller that includes a read only memory (ROM), a random access memory (RAM), and other computer sub-components that operate in conjunction with a software program, to initiate, control and terminate the opening of drawer, the extent to which it is allowed to be pulled open and to lock the drawer in the cabinet when the drawer is pushed closed in the cabinet.

25. The drawer of claim 24 further including a portion housing an and attached at the rear of said front portion and attached to said front portion by a hook extending from one said portion and received in a hook-receiving aperture formed in the other said portion so that said front portion can be disengaged therefrom and loaded with fresh supplies remote from the cabinet.

26. The drawer operating system of claim 24 wherein said bins are formed from a plurality of upstanding walls transversely arranged across the length of said container and integral therewith.

27. The drawer operating system of claim 24 including means for locking said second, engine-containing portion in the cabinet against movement outward or inward following disengagement of said first portion from said second portion.

28. The drawer operating system of claim 24 wherein said means, for locking said second, engine-containing portion in the cabinet against movement outward or inward following disengagement of said first portion from said second portion, include a latch pivotally mounted in said drawer and arranged to engage a first surface, mounted in the cabinet, to prevent further outward movement, and wherein said latch is further arranged to engage a second surface, mounted in the cabinet, to prevent further inward movement.

29. The drawer operating system of claim 28 wherein said first and said second surfaces are formed on a plate that is mounted in the cabinet and wherein said latch is spring-biased to a first position wherein it will engage both said first and said second surfaces when said first portion is disengaged from said second portion.

30. The drawer operating system of claim 24 further including a first shaft arranged parallel to said path of movement of said drawers, and having a portion thereof exiting the rear of said drawer and contacting a wall in the cabinet, said shaft having a first spring associated therewith urging said shaft rearward upon drawer closing to cushion the jarring effect of closing said drawer and to store potential energy for use in pushing said drawer partially out of the cabinet upon being unlocked from storage therein.

31. The drawer operating system of claim 30 further including a second spring held in partially compressed arrangement for retaining a drawer locking mechanism in a locked position.

32. The drawer operating system of claim 24 further including a second shaft, arranged parallel to said path of movement of said drawers, and connected to a trigger for engaging a cross-arm mounted outside the drawer, to lock said drawer in secure storage in the cabinet, and held in a locked position by a lever pivotally mounted in said second drawer portion.

33. The drawer operating system of claim 24 including a first shaft and a second shaft, both arranged parallel to said path of movement of said drawer and in spaced-apart arrangement with each other and interconnected by a lever and held in a jammed condition therebetween.

34. The drawer operating system of claim 24 further including a pin mounted on a moveable surface in the cabinet and arranged to extend forward into contact with said drawer to prevent further rearward movement of said drawer after said drawer is closed in the cabinet, said pin displaceable, by movement of said surface, to a new position aligned with an aperture to allow further rearward movement of said drawer, so that said drawer may be moved further inward said cabinet to cause unlocking thereof and subsequent movement forward into a fully opened condition.

35. The process of controlling the opening and closing of an elongated drawer, housed in a cabinet, said drawer defined by a front end and a rear end and sub-divided into a plurality of consecutively spaced bins for holding material therein, and arrange to move between a fully closed position and a plurality of progressively open position, comprising the steps of:

a) maintaining the drawer in a fully closed and locked position;

b) tracking the length of opening of the drawer on its immediately preceding excursion;

c) receiving coded information concerning the particular item needed and information as to the party entering the information;

d) unlocking the drawer, upon receipt of appropriate coded information, to allow the drawer to be manually pulled open a distance to expose the material contained therein at least one bin;

e) stopping further movement of the drawer when the appropriate bin has been exposed from the cabinet;

f) removing the stopping action of the drawer to allow it to be manually closed in the cabinet; and, g) locking the drawer in the cabinet upon manual shutting thereof.

36. The process of claim 35 further including the step of determining the rate of change of acceleration of the drawer as it is being opened, and stopping further outward movement of the drawer when said rate of change of acceleration of the drawer exceeds limits programmed into the system.

37. The process of claim 35 wherein the step of unlocking the drawer includes the additional step of partially opening the drawer to provide an indication that the drawer is further openable.

38. The process of claim 35 wherein the step of unlocking the drawer includes the additional step of controlling the drawer so that it is openable a distance in excess of the distance it traveled on its immediately preceding excursion.

* * * * *